US006921004B1

(12) United States Patent
Knickerbocker

(10) Patent No.: US 6,921,004 B1
(45) **Date of Patent: *Jul. 26, 2005**

(54) MANUALLY ACTUATED PUMP ASSEMBLY

(76) Inventor: Michael G. Knickerbocker, 1596 N. Falcon Dr., Saint George, UT (US) 84770

( * ) Notice: Subject to any disclaimer, the term of this patent is extended or adjusted under 35 U.S.C. 154(b) by 0 days.

This patent is subject to a terminal disclaimer.

(21) Appl. No.: 10/276,820

(22) PCT Filed: May 26, 2000

(86) PCT No.: PCT/US00/14550

§ 371 (c)(1),
(2), (4) Date: Nov. 18, 2002

(87) PCT Pub. No.: WO01/92146

PCT Pub. Date: Dec. 6, 2001

(51) Int. Cl.[7] ..... B65D 88/54
(52) U.S. Cl. ..... 222/321.2; 222/321.7
(58) Field of Search ..... 222/321.2, 321.7, 222/321.9

(56) References Cited

U.S. PATENT DOCUMENTS 3,583,605 A * 6/1971 Corsette ..... 222/321.9
4,051,983 A 10/1977 Anderson
4,189,064 A 2/1980 O'Neill et al.
4,986,453 A 1/1991 Lina et al.
5,064,105 A 11/1991 Montaner
5,083,682 A * 1/1992 Cater ..... 222/321.2
5,176,296 A 1/1993 Lina et al.
5,579,958 A 12/1996 Su
5,626,264 A 5/1997 Florez et al.
5,641,097 A 6/1997 Renault et al.
5,649,649 A * 7/1997 Marelli ..... 222/321.2
5,655,688 A 8/1997 Moore
5,664,706 A 9/1997 Cater
5,702,031 A 12/1997 Meshberg et al.
5,894,963 A 4/1999 Hirota
6,186,368 B1 * 2/2001 Knickerbocker ..... 222/321.2

* cited by examiner

*Primary Examiner*—Michael Mar
*Assistant Examiner*—Patrick Buechner
(74) *Attorney, Agent, or Firm*—Davis & Bujold, P.L.L.C.

(57) ABSTRACT

A finger operated pump assembly comprising a pump body (60, 160) having a base (64, 164) supporting an outer housing (62, 162) and an inner housing (66, 166) and defining a first portion of a compression chamber (68) therebetween. A piston (82) has an annular lip and has a piston outlet defined by a poppet valve seat. A poppet (98) is accommodated by the inner housing (66, 166) and biased away from the base into engagement with the poppet valve seat by a spring (104). The poppet (98) and inner housing (66, 166) define an interior cavity (100). A peripheral passageway (74) communicates with the compression chamber (68) and includes a one-way valve (76). A ventilation port (110) is provided int the interior cavity (100) so that during operation of (98), it may operate at ambient pressure.

25 Claims, 8 Drawing Sheets

MANUALLY ACTUATED PUMP ASSEMBLY

FIELD OF THE INVENTION

The invention relates to an improved manually operated pump assembly, categorized as an accumulative pump, for dispensing a product under high pressure. The pump assembly comprises a compression chamber for pressurization of the product to be dispensed and a relief valve operating, substantially at ambient atmosphere, for controlling the release of product through a piston outlet of the pump.

BACKGROUND OF THE INVENTION

A variety of prior art manually operated hand-held pump assemblies are well known and used for dispensing a variety of products such as liquids for personal care and pharmaceutical uses, fragrance products and the like. Pumps of this type comprise a housing body and a slidable piston which together define a compression chamber for receiving and dispensing of the product. The body, as well as the internal components contained within the body, are retained by a turret. An inlet in the base of the body communicates, via a dip tube, with the product to be dispensed. A conventional spray actuator communicates with an outlet of the piston to facilitate operation of the pump and provides a mechanical mechanism for dispensing the product, as desired, by an operator.

Directional flow of product to be dispensed, from the interoir of the container into the compression chamber of the body, is controlled by a first one-way valve, typically located at or adjacent to the coupling of the body inlet to the dip tube. A second one-way valve enables the product to be dispensed from the compression chamber through the piston outlet and into a supply passage of the actuator. Finally, the product is dispensed out through a discharge orifice of the actuator.

It is desirable for the pump to reach a specified pressure, prior to releasing the product to be dispensed from the compression chamber, to ensure that the product dispensed out the discharge orifice exhibits consistent and uniform spray characteristics. For example, some sprays need to consist of particles of uniform size, e.g. particles lying within a narrow particle size range, in order for proper dispensing of the product. It is also desirable to dispense a specific dosage of product during a single actuation of the actuator. To accomplish both the desired dosage and particle size requirements, the construction and function of the pump assembly require accurately designed internal components which must be precisely controlled during operation of the pump assembly. Because the body, the piston, the spring, the valve, etc., determine the configuration and operating pressure of the compression chamber, these components are very important in controlling the function of the pump assembly.

Product dispensing requirements are increasingly more demanding. With an increase in the use of low volatile solvents, as the main carrier component for the product to be dispensed, and as well as using more viscous gel-type liquids, the design requirements for dispensing such products are more critical. In particular, the low volatile solvents and the viscous gel-type liquids require higher discharge pressures, to facilitate proper dispensing thereof, versus products that include solvents which are readily converted into vapor upon discharge. In an attempt to overcome this problem and facilitate control of the resulting spray configuration, many prior art pump assemblies use a single spring to both actuate the piston and also bias a second one-way valve. This single spring forces the piston back into its initial static position, once the actuator has actuated the piston, and holds the second one-way valve closed until a desired operating pressure is reached.

Other prior art designs use a first spring for returning the piston and a second spring for biasing the second one-way valve independently of the piston. The intended advantage of the two spring arrangement is that the second one-way valve spring can be independently adjusted to facilitate opening of the piston valve at a desired operating pressure. In either case, the second one-way valve and the spring(s) are all contained within the compression chamber of the body and are subjected to the generated operating pressure within the compression chamber. The spring(s) (or other known conventional biasing members) are typically located to bias the second one-way valve against a piston valve seat. The amount of pressure required to compress the spring, and thus move the second one-way valve away from its associated valve seat, determines the operating pressure of the pump assembly. The construction of the spring thus determines the pressure at which the product is displaced from the body out through the discharge orifice. The spring pressure translates into a high reaction force upon the product as it is released by the second one-way valve and overcomes the spring bias.

It is to be appreciated that in order for the pump assembly to dispense liquid properly, the pump section of the assembly must be initially purged of any air contained within the compression chamber-this initial purging step is commonly referred to as "priming" of the pump. When the actuator is initially depressed by an operator, any air contained within the compression chamber of the body must be displaced in order for product to be siphoned into the compression chamber of the body via the dip tube. By depressing the actuator, the piston is moved toward a base of the body thereby compressing the spring as well as any air contained within the compression chamber. The compressed air assists with maintaining the first one-way valve in a closed position. The compressed air also induces an opening force on the second one-way valve but, in most cases, the induced force of the compressed air may never reach a high enough pressure to overcome the spring closing force of the second one-way valve. For this reason, prior art pumps use a small rib(s), or some other mechanical device located near the end of the compression stroke, to disrupt the seal between an inner part of the body and the piston and allow the compressed air to escape from the compression chamber. Two methods are used for allowing the compressed air to escape from the compression chamber. The first method is to allow the air to escape around the piston which can result in residual product drying along the escape path and seizing the piston. The second method is to allow air to escape down the dip tube which results in the air and the product to be dispensed reciprocating back and forth within the tube, which is also undesirable.

Because both the second one-way valve and the spring occupy space inside the body, these components effect the compression of the air during the priming operation of the pump, and thus effect the operation of the second one-way valve. This also means that the product, siphoned via the dip tube into the body, is then pushed back through the system in the reverse direction as the piston reciprocates. This to and fro movement of the air and the product reduces the efficiency of the pump and increases the force needed to operate the system. In addition, the number of strokes required in order to remove the air contained within the compression chamber is increased.

SUMMARY OF THE INVENTION

Wherefore, it is an object of the present invention to overcome the aforementioned problems and drawbacks associated with the prior art pump assembly designs.

Another object of the present invention to design a pump assembly, utilizing a smaller number of components, which is efficiently primed and operated while still ensuring a high dispensing efficiency for the pump assembly.

A further object of the invention is to provide a movable poppet which operates at ambient pressure so that the function of the poppet is essentially unaffected by the flow or circulation of the product to be dispensed within the compression chamber.

Still another object of the invention is to increase the compression efficiency of the pump assembly and also minimize the number of strokes required to "prime" the pump assembly by providing a spring which is not located along or in communication with the product dispensing flow path so that the spring is not hindered by and does not hinder or interfere with the flow of the product to be dispensed.

Yet another object of the invention is to provide a simpler, lower cost, higher quality and efficient spray pump assembly that provides the same spray characteristics for low volatile solvents, water based products, alcohol base and/or other formulas.

A still further object of the invention is provide a pump assembly having a dispensing dosage of between about 120–250 ml of product, or so, an actuation force of between about 5.5–7.5 lbs., or so, and an internal operating pressure of the compression chamber of between about 100 to 170 psi, or so.

The manually actuated pump assembly, according to the present invention, is capable of dispensing a wide range of products. The highly efficient internal volume and priming system, according to the present invention, renders the manually actuated pump assembly ideal for use with personal care products, pharmaceuticals, fragrances, etc. A majority of the structural components of the manually actuated pump, according to the present invention, are located outside of the compression chamber thereby allowing minimal clearance between the inwardly facing surfaces defining the compression chamber when those surfaces are moved into the fully actuated position. Such design of the pump assembly aids in both priming and normal operation of the pump assembly.

Priming is accomplished by venting the trapped air either out through the discharge orifice or past a seal formed between the poppet and an inner cylindrical housing, rather than down the dip tube or around the compression piston. The prior art dispensing systems, that prime through the dip tube, experience difficulties when dispensing gels or high water content products or when utilizing a long length dip tube. As note above, the pump assemblies that prime around the compression piston have a tendency to become clogged or seized due to drying of the product residue.

During normal operation, according to the present invention, the pump assembly has a high operating pressure due to the ratio of the compression chamber diameter to the piston stroke length. With an operation pressure of approximately 130 psi or so, the manually actuated pump according to the present invention operates about 30% higher than conventional pumps currently available on the market today. Another advantage of the high compression design, of the present invention, is the uniform spray consistently achieved during each dispensing stroke. In addition, less variation in the internal volume results by locating the spring and valving components external of the compression chamber. Lastly, the improved profile of the components provides substantially unrestricted flow of the product from the compression chamber to the discharge orifice.

Finally, the present invention relates to a finger pump apparatus comprising a container for housing a desired product to be dispensed, said container being closed at one end and having a spout to facilitate dispensing of the product to be dispensed; a pump body having a base supporting an outer housing and an inner housing, and said outer housing and said inner housing at least partially defining a compression chamber therebetween; a closure supporting said pump body, and said closure sealingly engaging with the spout of the container, a piston being at least partially received within said pump body and being slidable relative to said pump body along said outer housing, said piston having an annular lip for providing a sealing engagement with the pump body, and said piston being provided with a poppet valve seat defining a piston outlet; an actuator being coupled to said piston outlet, and said actuator having a discharge outlet communicating with piston outlet for facilitating dispensing of a product; a poppet being accommodated by said inner housing, said poppet being biased away from said base of said pump body by a spring into engagement with said poppet valve seat to normally close said piston outlet and prevent flow of product therethrough, and said poppet, said base and said inner housing defining an interior cavity, and said interior cavity being provided with a ventilation port which allows said interior cavity, during operation of said poppet, to communicate with an interior of the container so that the interior cavity operates at ambient pressure; a passageway communicating with said compression chamber, said passageway including an inlet with a one-way valve which allows the product to flow along said passageway toward said compression chamber; and a dip tube coupling the inlet of the passageway to a base portion of said container to facilitate pumping of the product to be dispensed by the pump assembly.

DESCRIPTION OF THE PREFERRED EMBODIMENT

While this invention is susceptible to various embodiments, the specification and the accompanying drawings disclose two specific forms as examples of the present invention. For ease of description, the pump assembly embodying this invention is described in the normal operating position, in terms such as: upper, lower, horizontal, etc., are used with reference to this position. It will be understood, however, that the pumps and components embodying this invention may be manufactured, stored, transported, used, and sold in an orientation other than the position described.

Figure 1:
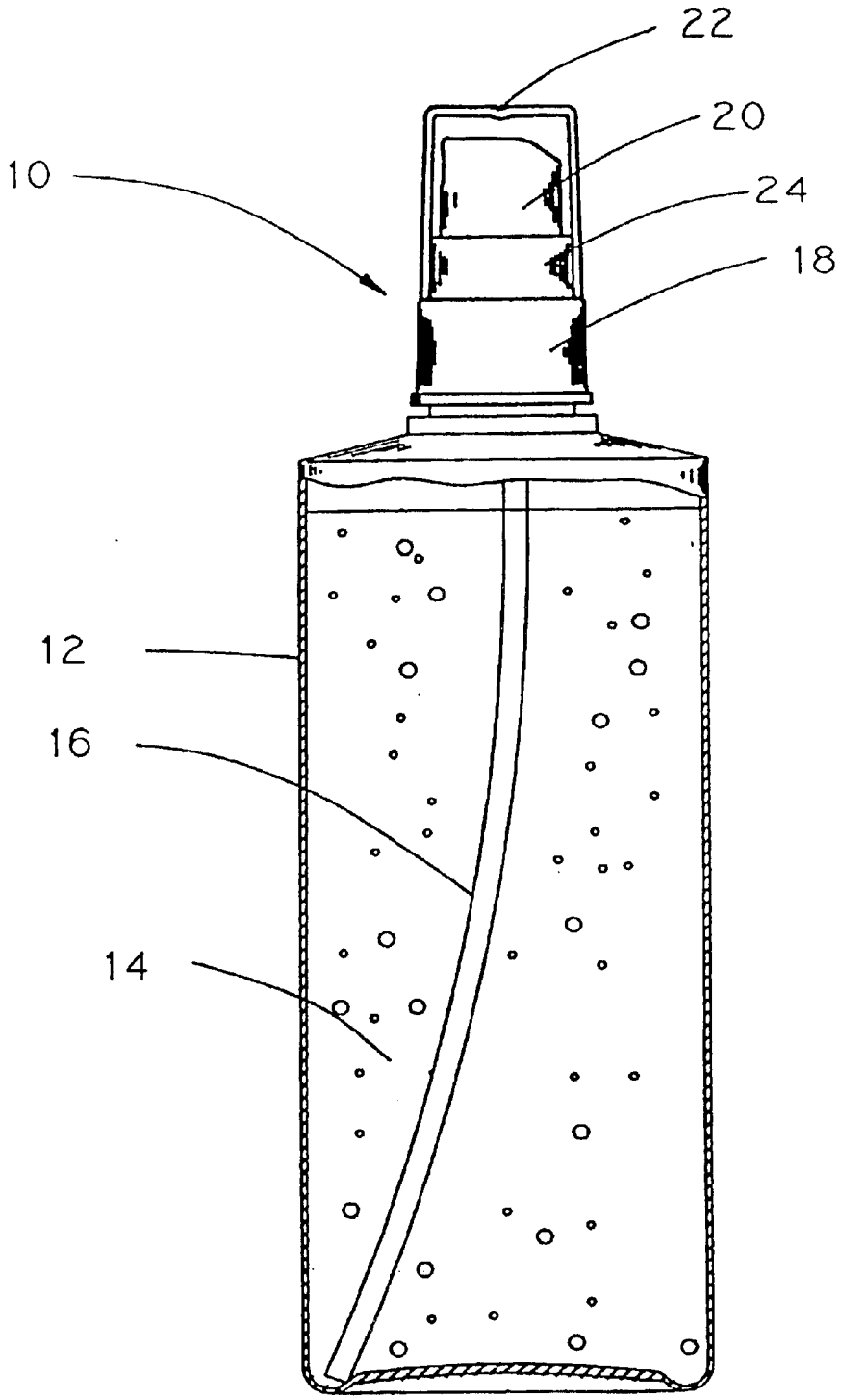
FIG. 1 is a diagrammatic front perspective view of a container supporting the improved pump assembly according to the present invention.

Turning first to FIG. 1, a brief description concerning the improved pump assembly 10, according to the present invention, used in combination with a prior art container 12 will now be provided. As can be seen in this Figure, the container 12 is a generally closed plastic container which has a spout (not shown in detail) formed on the top surface of the container. The spout is provided with an external thread (not shown) and has an aperture or opening formed therein to provide communication with an interior of the container 12. The container 12 accommodates a desired quantity of liquid, fluid or some other product to be dispensed 14. The product to be dispensed 14 is typically supplied from an interior space or area of the container 12, via a dip tube 16, to an inlet of the pump assembly 10. As is well known in the art, the bottom end of the dip tube 16 is normally submerged in the liquid or product when the container is in a generally in an upright orientation, as illustrated in FIG. 1. A further detailed description concerning the function of the dip tube 16 will be provided below.

The pump assembly 10 is provided with removable cap or closure 18 which accommodates a depressible actuator 20 that is movable relative to the closure 18 to facilitate actuation of the pump assembly 10, and a further detailed description concerning the purpose of such depression will follow below. If desired, a removable hood or overcap 22, can encase or enclose the actuator 20 to prevent inadvertent actuation thereof. The overcap 22 is hollow shell member and typically has a perimeter edge that has a friction fit with a hollow annular skirt 24 extending from a top surface of the closure 18. As such overcap feature in conventional and well known in the art, a further detailed description concerning the same is not provided.

With reference now to FIGS. 2–6, a detailed description concerning a first embodiment of the improved pump assembly 10, according to the present invention, will now be provided. As can be seen in FIGS. 3–6, for example, the base portion of the closure 18 is provided with an annular base flange 26 which is located to abut against a mating flange surface (not shown in detail) of the container 12. In addition, the closure 18 is provided with a central through bore 28 extending through the closure 18 along a longitudinal axis L of the improved pump assembly 10. An inwardly facing surface 29 of the base of the closure 18 is provided with an internal thread 30 (or some other conventional retaining recess, lip or mechanism) for engagement with a mating external thread (or some other mating conventional retaining recess, lip or mechanism) provided on the spout of the container 12. The closure 18 is also provided with a substantially centrally located, radially inwardly extending horizontal closure annular flange 32 which separates a base portion of the closure 18 from the annular skirt 24. The closure annular flange 32 facilitates retention of the various components of the improved pump assembly 10 as will be discussed below in further detail.

A top surface of the actuator 20 is provided with a finger recess 34 which is preferably shaped or contoured to facilitate engagement with an index finger of an operator. As such shaping or contouring feature is well known in the art, a further description concerning the same is not provided. The actuator 20 is further provided with a downwardly extending annular side wall 36 which has a diameter that is slightly less than an inside diameter of the annular skirt 24 of the closure 18 to allow the annular side wall 36 of the actuator 20 to move relative to the annular skirt 24, e.g. to move in and out of the space encompassed by the annular skirt 24 of the closure 18 without excess friction or contact occurring between those two components. According to a preferred embodiment of the invention, there is a relative sliding motion between an outwardly facing surface of the annular side wall 36 and an inwardly facing surface of the annular skirt 24 to facilitate guiding the actuator 20 as it is actuated or depressed toward the closure 18. Such sliding motion facilitates maintaining the actuator 20 in its correct upright dispensing orientation.

An internal longitudinal central bore 38 is formed within the interior of the actuator 20 and the central bore 38, in turn, communicates with a transverse radial bore 40. The transverse radial bore 40 terminates at an opening formed in an exterior surface of the actuator which is sealed or closed by insert member 42. The insert member 42 has a discharged orifice 44 formed therein. The discharged orifice 44 facilitates dispensing of the product to the dispensed 14 out of the actuator into the external environment. The insert member 42 is received within the transverse radial bore 40 and an outer periphery of the insert member 42 has a friction fit with an inner wall defining the transverse radial bore 40 to permanently retain the insert member 42 therein. An inwardly facing surface, located on the base of the insert member 42, engages with an outwardly facing planar end surface of a central post 46 accommodated within the radial bore 40. The end surface of the post 46 has a plurality of conventional radially inwardly directed channels 48 which lead to a conventional mixing chamber (not separately numbered) centrally formed on the end surface of the post 46. It will be apparent to one skilled in the art that the plurality of radially inwardly directed channels 48 and the mixing chamber may also be located on and supported by the inwardly facing base surface of the insert member 42, instead of the post 46, for engagement with a substantially flat end surface of the post 46. The mixing chamber directly communicates with the discharge orifice 44 for dispensing the throughly mixed and/or swirled product to be dispensed 14 out through the discharge orifice 44. As this dispensing arrangement is conventional and well known in the art, a further detailed description concerning the same is not provided.

The closure annular flange 32 of the closure 18 mates with an annular flange 50 of a turret 52 (see FIG. 3 for example) and also supports a gasket or liner 58. The gasket or liner 58 is provided with a central aperture and is employed for biasing the annular flange 50 of the turret 52 against the closure annular flange 32 of the closure 18, when the closure 18 is secured to the container 12. The closure annular flange 32 of the closure 18 and the gasket or liner 58 sandwich the annular flange 50 of the turret 52 therebetween as the closure 18 is secured to the spout of the container. Such sandwiching arrangement is conventional and well known in the art.

An annular side wall 54 of the turret 52 extends through a central aperture, provided in the closure annular flange 32, and the annular side wall 54 extends substantially parallel to the annular skirt 24 of the closure 18 and is spaced therefrom a sufficient distance to allow the annular side wall 36 of the actuator 20 to be readily received therebetween without an undue interference from the side wall 54 during operation of the actuator 20. A top free end portion of the turret 52 is provided with an annular retaining edge 56 which first extends radially inwardly and then extends downwardly a short distance, along the longitudinal axis L, toward the base of the closure 18. A further detailed description concerning the purpose of the retaining edge 56 will be provided below. An annular lip 59 (see FIG. 2) is provided on an inwardly facing surface of the annular side wall 54 of the turret 52 to facilitate retention of a pump body 60 and a further description concerning the purpose of the same will follow.

Figure 2:
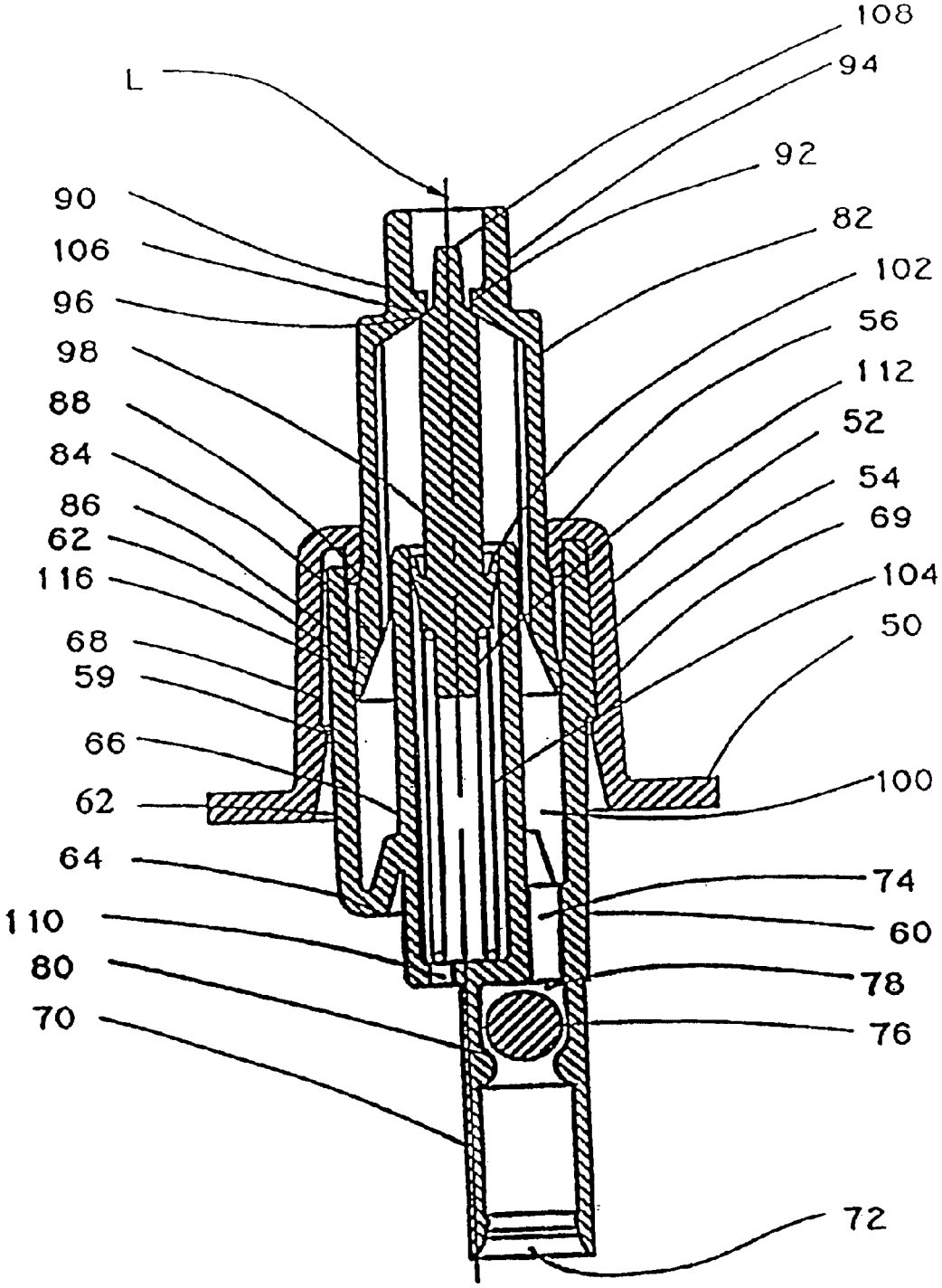
FIG. 2 is a diagrammatic cross-sectional view of a first embodiment of the improved pump assembly, according to the present invention, shown in a static position without an overcap, an actuator, a closure, a liner, or a dip tube affixed thereto.

The pump body 60, as can be seen in further detail with reference to FIG. 2, comprises an outer cylindrical housing 62 which is connected to a base 64 of the pump body 60 to form a single unitary component or structure. An inner cylindrical housing 66 is integrally connected to the base 64, of the pump body 60, and the inner cylindrical housing 66 is located concentric with the outer cylindrical housing 62 but spaced therefrom. A exterior surface of the pump body 60 supports an annular nub 69 which is located to engage with the annular lip 59 of the turret 52 and secure the pump body 60 to the turret 52. A lower portion of the pump body 60 is provided with a cylindrical extension 70 having an inlet aperture 72 formed in a base end surface thereof. A first end of the dip tube 16 is frictionally received and retained within the inlet aperture 72, as is conventionally done in this art.

Figure 3:
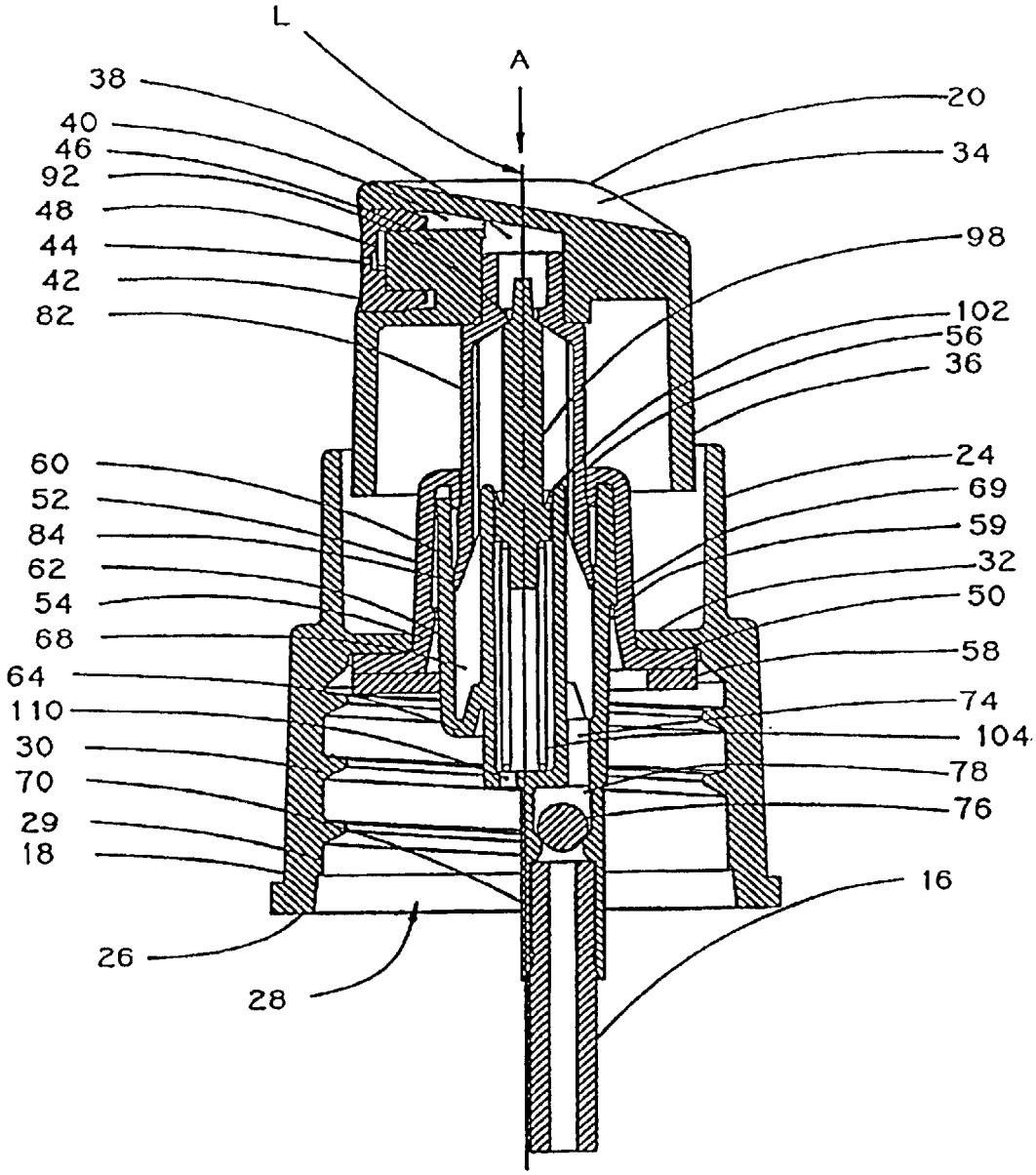
FIG. 3 is a diagrammatic cross-sectional view of the first embodiment of the improved pump assembly, according to the present invention, shown in the static position with an actuator, a closure, a liner and a dip tube attached thereto.
Figure 4:
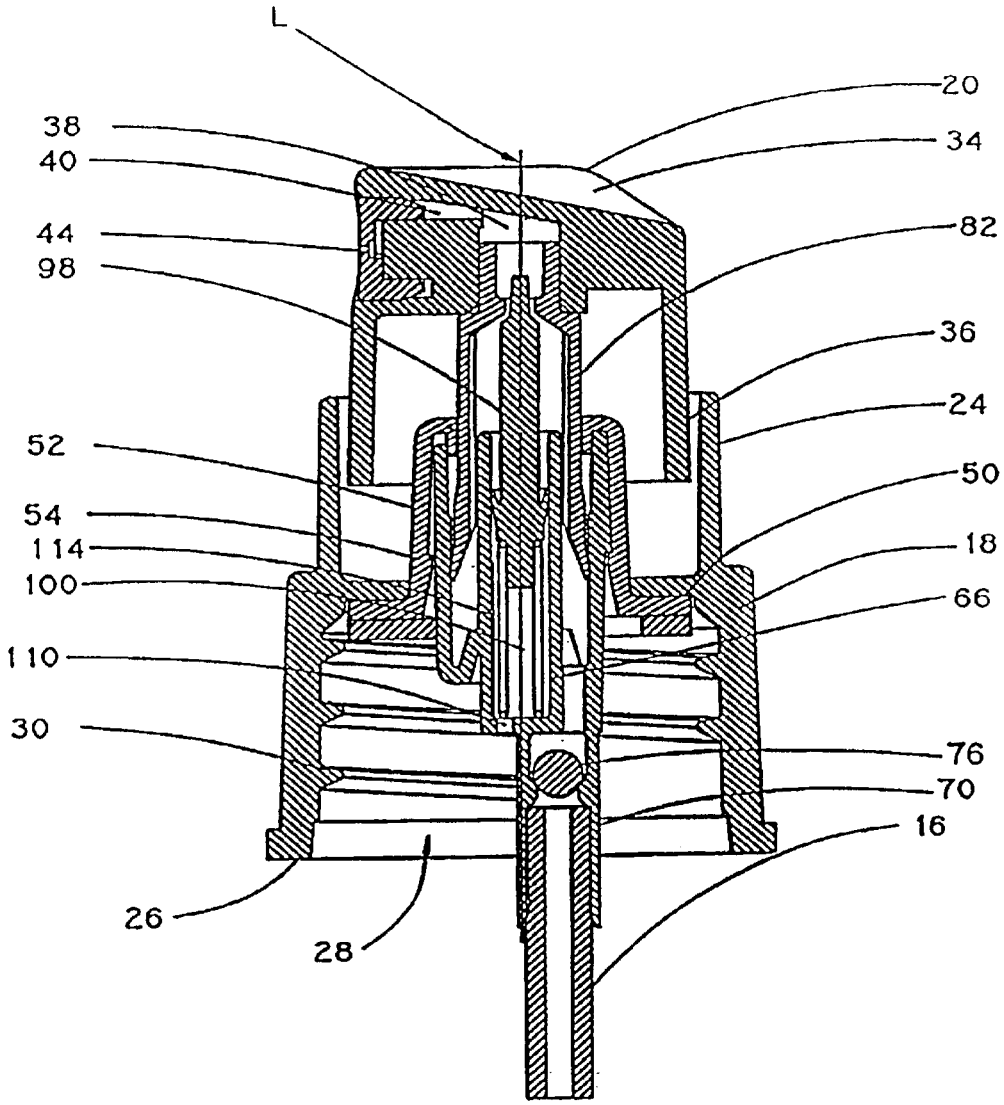
FIG. 4 is a diagrammatic cross-sectional view, of the first embodiment of the improved pump assembly of FIG. 3, shown in a partially depressed position in which the poppet has been sufficiently displaced from the poppet annular seat to commence dispensing of product.
Figure 5:
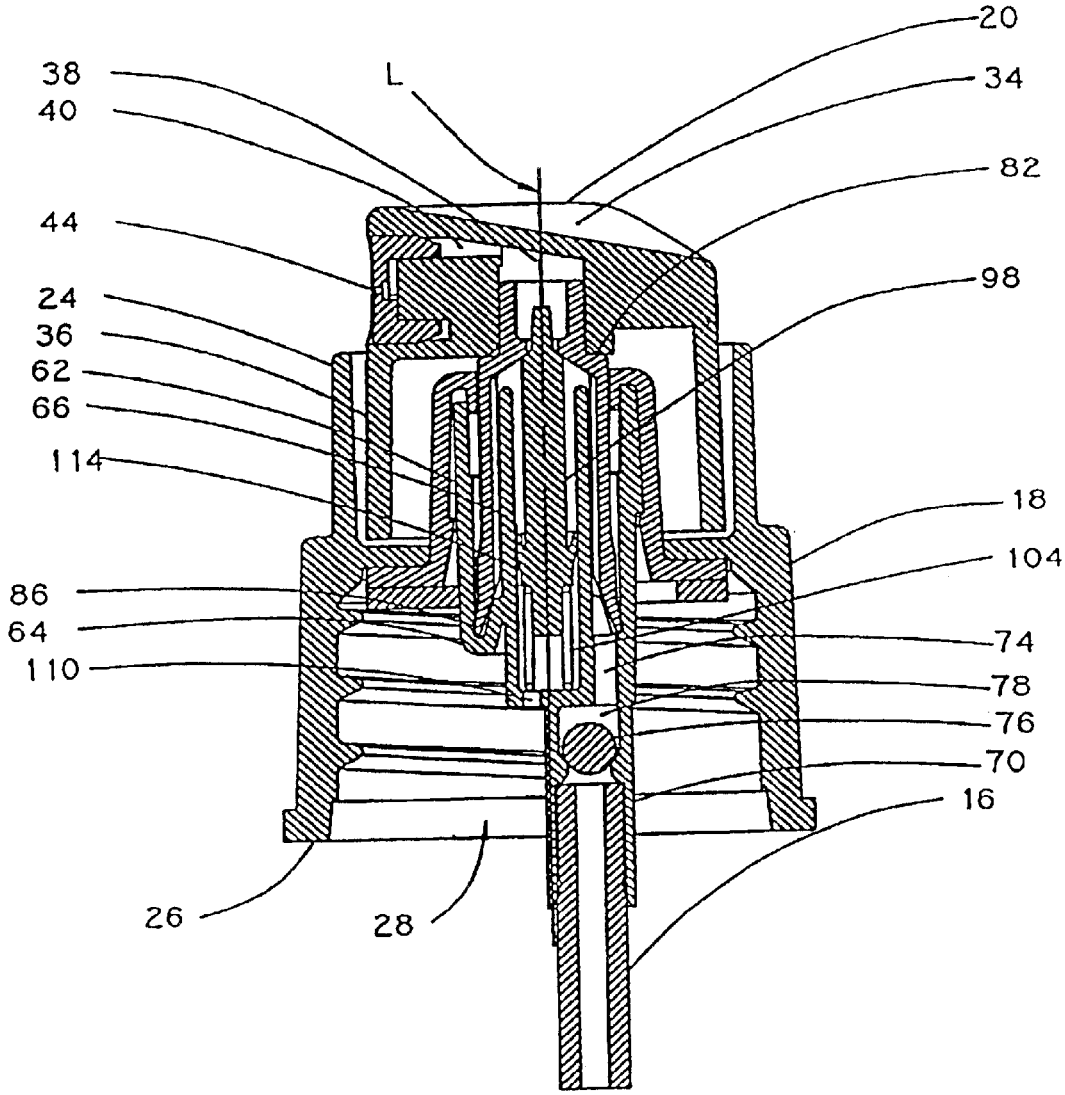
FIG. 5 is a diagrammatic cross-sectional view of the first embodiment of the improved pump assembly of FIG. 3 showing the fully depressed position of the pump assembly.

The inlet aperture 72 communicates with a first portion of a compression chamber 68, formed between an exterior surface of the inner cylindrical housing 66 and an inwardly facing surface of the outer cylindrical housing 62, via a longitudinal passageway 74. The longitudinal passageway 74 extends parallel to but is spaced radially from the longitudinal axis L of the pump assembly. A one way valve is located along the longitudinal passageway 74 and the one-way valve comprises a metal ball 76 that is captively retained within a cage 78. The cage 78 allows limited to and fro movement of the ball 76 to facilitate opening and closing of the one-way valve. This one-way valve allows the product to flow along the longitudinal passageway 74 when the ball 76 is spaced from an annular ball seat 80 (see FIG. 6). The ball 76 normally rests, as can be seen in FIGS. 3–5, against the annular ball seat 80 to shut off product flow through the longitudinal passageway 74. Prior to inserting the dip tube 16 within the inlet aperture 72, the metal ball 76 is forced into the inlet aperture 72, and urged past the annular ball seat 80 into the cage 78 where the ball 76 is thereafter permanently retained and utilized to operate the one-way valve.

It is to be appreciated that the ball 76 is normally held by gravity in a sealing position over the opening defined by the annular ball seat 80 so as to prevent the compressed liquid from being forced back down into the dip tube 16. During actuation of the actuator, i.e. either during priming of the pump or dispensing of product, the generated pressure within the compression chamber additional serves to hold the ball 76 in its sealing engagement against the annular ball seat 80. A further detailed description concerning the purposed of the same will follow below.

A piston 82 is at least partially accommodated within the body 60 and the piston 82 is slidably movable relative to the body 60. A first lower end 84 of the piston 82 is provided with an annular sealing lip 86, having an outer circumference slightly larger than the inner dimension of the outer housing 62 to provide a tight sealing engagement between the annular sealing lip 86 and the inner surface of the outer housing 62. During operation of the piston 82, as will be described below in further detail, the pressure generated within the compression chamber 68 assists with forcing the annular sealing lip 86 of the piston 82 into sealing engagement with the inwardly facing surface of the outer cylindrical housing 62. An exterior surface of the piston 82, adjacent the annular sealing lip 86, is provided with an annular shoulder 88 which abuts against the annular retaining edge 56 of the turret 52 to captively retain at least the first lower end 84 of the piston 82 within the pump body 60.

The piston 82 is a generally hollow member which has an exterior side wall that may taper slightly from the first lower end 84 to a second remote end 90. A piston outlet 92 is formed adjacent the second remote end 90 of the piston 82. The second remote end 90 of the piston 82, located adjacent the piston outlet 92, is provided with a reduced diameter annular cylindrical sidewall 94 which is sized to be frictionally received within the central bore 38 of the actuator 20 and provide a secure retaining engagement between the second remote end 90 of the piston 82 and the actuator 20. An annular surface of the piston 82, defining the piston outlet 92, forms the poppet valve seat 96. The piston outlet 92 is normally closed by a shoulder 106 of an elongate generally cylindrical poppet 98 which is biased against the poppet valve seat 96 via a spring 104. When the cylindrical poppet 98 becomes spaced from the poppet valve seat 96, during actuation of the pump assembly, the piston outlet 92 is opened and allows the product to be dispensed 14 to flow from the compression chamber 68 to the central bore 38 of the actuator 20, and a further detailed description concerning the same will be provided below.

As stated above, a first portion of the compression chamber 68 is formed between the inner cylindrical housing 66 and the outer cylindrical housing 62. A remaining second portion of the compression chamber 68 is formed between an inwardly facing surface of the piston 82 and an exterior surface of the poppet 98. The hollow interior dimension of the piston 82 is slightly larger than the outer diameter of the inner cylindrical housing 66 and either the piston 82 and/or the inner cylindrical housing 66 may have a channel(s) formed thereon so that the first portion of the compression chamber 68 is in constant communication with the remainder of the compression chamber 68 regardless of the position of the piston 82 relative to the inner cylindrical housing 66.

The cylindrical poppet 98 is accommodated within a central cavity 100 defined by the inner cylindrical housing 66. The poppet 98 is a solid elongate generally cylindrical member which supports an annular sealing and guide surface 102 adjacent a first lower end thereof. The annular sealing and guide surface 102 is sized to have an slight interference sliding fit with the inwardly facing surface of the inner cylindrical housing 66. The annular sealing and guide surface 102 slides along the inwardly facing surface of the inner cylindrical housing 66, in a sealed manner during operation of the pump assembly, and maintains the poppet 98 aligned with respect to the longitudinal axis L of the pump assembly 10. The poppet 98 is biased into a normally closed position, via a spring 104 accommodated within a centrally located interior cavity 100, so that the shoulder 106 of the poppet 98 abuts against the poppet valve seat 96, formed on the piston 82, to shut off flow through the piston outlet 92. As can be seen in FIG. 2, for example, the poppet 98 has a tapered or smaller constant diameter appendage 108 that extends through the piston outlet 92 and facilitates maintaining proper alignment of the poppet 98 with respect to the outlet 92 during operation of the pump assembly.

A base of the centrally located interior cavity 100, accommodating the spring 104, is provided with a ventilation port 110 which provides communication between the centrally located interior cavity 100 and an interior space of the container 12 to ventilate the interior cavity so that the centrally located interior 100 is at ambient pressure. The ventilation port 110 prevents the creation of either excess pressure or vacuum in the centrally located interior 100 during operation of the pump assembly 10. A lower most portion of the poppet 98, opposite the appendage 108, is provided with a cylindrical extension 112 which receives one end of the spring 104 and further facilitates proper alignment and engagement between the poppet 98 and the spring 104.

In a preferred form of the invention, a lower inwardly facing surface of the inner cylindrical housing 66 is provided with at least one nub or some other protrusion 114 so that when the annular sealing guiding surface 102 of the poppet 98 engages with the nub or other protrusion 114, the remaining pressure in the compression chamber 68 is relieved and flows downward through the centrally located interior cavity 100 and out through the ventilation port 110, provided in the base 64, into the interior space of the container 12. It is to be appreciated that the nub or other protrusion 114 is formed on an inwardly facing surface of the inner cylindrical housing 66 at a location near the end of the stroke of the poppet 98, e.g. after the poppet has moved about 95% to 98% of is normal operating stroke within the inner cylindrical housing 66, so as not to compromise significantly the pumping efficiency of the compression chamber 68.

The use of the protrusion or nub 114 is very useful in "priming" the air normally contained within the compression chamber 68 of the pump assembly following the manufacturing process. Since air is a compressible fluid, the compressed air typically may not generate, even after the full compression stroke of the actuator 20, a sufficient pressure to bias the poppet shoulder 106 away from the poppet valve seat 96 and thereby allow discharge of the compressed air out of the compression chamber 68 into the central bore 38 of the actuator 20. According to the present invention, if the actuator 20 is substantially completely depressed and the poppet shoulder 106 still has not been biased away from the poppet valve seat 96 to thereby open the piston outlet 92, the air is immediately released by the breach in the seal formed between the annular sealing and guide surface 102 and the inwardly facing surface of the inner cylindrical housing 66, once the annular sealing and guide surface 102 engages with the nub or the protrusion 114. This released air is conveyed through the central cavity 100 and out the ventilation port 110. On the return stroke of the actuator 20, however, as soon as the annular sealing and guide surface 102 clears the nub or the protrusion 114 and again establishes a seal with the inner cylindrical housing 66, a siphoning action is created within the compression chamber 68 and a quantity of the product to be dispensed 14 is siphoned, via the dip tube 16 and passageway 74, toward the compression chamber 68. This siphoned product will eventually flow into the compression chamber 68 where the product, which is generally an incompressible fluid, will actuate the poppet 98 in its intended dispensing manner after a sufficient number, e.g. four (4), of priming strokes.

It is to be appreciated that if replacement air is not allowed to enter inside the container 12 and replace the volume of dispensed product 14, during normal operation of the pump, the container 12 will progressively become evacuated and eventually deform inwardly and/or collapse once a substantial portion of the product to be dispensed is sprayed. To alleviate this problem, at least one groove 116 is provided along either an exterior surface of the body 60 or an inwardly facing surface of the turret 52. This groove 116 is normally sealed off from the external environment by the piston shoulder 88 engaging with the annular retaining edge 56 to provide a seal therebetween. Once the piston 82 is sufficiently depressed, the exterior surface of the piston 82 is slightly spaced from the annular retaining edge 56 to allow ambient air to flow along the exterior surface of the piston 82 and around the retaining edge 56 and down along the groove 116, located between the exterior surface of the body 60 and the inwardly facing surface of the turret 52, to replace the volume of the product which was just dispensed by the actuator 20. This ventilation groove 116 also maintains the pressure inside the container at substantially the same pressure as the external surrounding environment.

Now that a detailed description concerning the basic components of the pump assembly, according to the present invention, were provided, a detailed description concerning actuation of the pump assembly will now be described.

Initially the pump assembly 10 is first installed on a spout of a desired container 12, containing a product to be dispensed 14, by engaging the threads 30 of the closure 18 with a mating thread, or some other conventional retaining mechanism, provided on an exterior surface of the spout of the container 12. Once this has occurred, the dip tube 16 of the pump assembly is submerged within the product to be dispensed 14 such that an inlet of the dip tube is located adjacent a base of the container 12. The pump assembly 10 is now ready for actuation.

When actuation is desired, the operator places his or her index finger on the finger recess 34 and depresses the actuator 20, in the direction of arrow A of FIG. 3, so as to bias the actuator 20 downwardly along the longitudinal axis L toward the closure 18. Such depression of the actuator 20, in turn, causes a depression of the piston 82 which results in the annular sealing lip 86 sliding along the inwardly facing surface of the outer cylindrical housing 62 in an sealed manner toward the base 64 of the body 60. This action causes the product to be dispensed 14, contained within the compression chamber 68, to come under pressure, i.e. it is to be noted that a liquid is generally incompressible. As the pressure of the product to be dispensed increases, this increase in pressure serves to bias the ball 76 against the annular ball seat 80 and thereby prevent the escape of any product downwardly back along the dip tube 16. As noted above, the inwardly facing surface of the piston 82 is spaced a sufficient distance away from the outwardly facing surface of the inner cylindrical housing 66 to allow the product to be dispensed 14 to continuously flow therebetween regardless of the position of the piston 82. Once the pressure within the compression chamber 68 increases to a sufficient pressure, e.g. an operating pressure of about 130 psi, the generated pressure of the product to be dispensed 14 overcomes the biasing force of the spring 104 and forces the poppet 98 downwardly toward the base 64 of the interior cavity 100 against the action of the spring 104. This movement results in a compression of the spring 104 which allows the poppet shoulder 106 to separate away from the poppet valve seat 96 and thereby establishes a product flow path through the piston outlet 92, as can be seen in FIG. 4.

Once the poppet shoulder 106 is sufficiently spaced from the poppet valve seat 96, the product to be dispensed 14 rushes through the piston outlet 92 and flows upwardly through the central bore 38, the radially bore 40, the inwardly directed channels 48 and is dispensed out through the discharge orifice 44 in a manner which generates a substantially uniform discharge spray configuration from the actuator 20. The piston 82 continues to force the product to be dispensed 14 out through the actuator 20, during further downward motion of the actuator in the direction of arrow A, until the annular lip 86 of the piston 82 abuts against the base 64 of the body 60, as seen in FIG. 5. Once the pump assembly is in its fully depressed position, an inwardly facing surface of the base 64 of pump body 60 is contoured to closely accommodate and substantially mirror the inwardly facing surface or profile of the annular sealing lip 86 of the piston 82 and thereby minimize the amount of the product to be dispensed 14 still remaining in the compression chamber 68, e.g. the volume of the compression chamber is minimized by this arrangement. As is apparent from FIG. 5, the volume of the compression chamber 68 has been significantly reduced so that a substantial portion of the product to be dispensed 14, that was previously stored within the compression chamber 68, has been dispensed by the actuation stroke of the actuator 20.

It is to be appreciated when the annular sealing and guide surface 102, seen in FIG. 5, engages with the nub or the protrusion 114, formed near a lower portion of the inner cylindrical housing 66, the seal therebetween is breached and most of the remaining product to be dispensed, or air during initial priming of the pump assembly, is conveyed through the interior cavity 100 and out the ventilation port 110 to quickly relieve the generated pressure of the compression chamber 68.

Once the actuation stroke is completed, the finger actuation pressure of the operator is relieved, e.g. the finger of the operator is removed from the finger recess 34. Thereafter, the spring 104 immediately biases the poppet 98, in the direction of arrow B of FIG. 6, toward and against the poppet valve seat 96 of the piston 82 to quickly close the piston outlet 92 and thereby prevent the further flow of the product to be dispensed 14 therethrough. The spring 104 also biases, due to biasing of the poppet 98 in the direction of arrow B, the piston 82 and the actuator 20 in an upward direction away from the closure 18. During this return stroke of the pump assembly 10, additional product to be dispensed 14 is siphoned into the inlet formed in the second end of the dip tube 16. The siphoned product to be dispensed 14 flows along the dip tube 16 and moves or displaces the ball 76 away from the ball seat 80 to allow passage of the product to be dispensed 14 therepast along the longitudinal passageway 74.

It is to be appreciated that the cage 78 captively retains the ball 76, e.g. opens this one-way valve but retains the ball 76 so that the ball 76 may fall, due to the effects of gravity, back on the ball valve seat 80 following completion of the pump assembly return stroke to close this one-way valve. The product to be dispensed 14 continues to flow along longitudinal passageway 74 into the compression chamber 68 where the product to be dispensed 14 is accumulated and stored, as can be seen in FIG. 3. Once the spring 104 has biased the poppet 98, in the direction of arrow B, a sufficient distance such that the shoulder 88 of the piston 82 abuts against the annular retaining edge 56, the ball 76 is again allowed to settle on ball valve seat 80 to thereby prevent further flow and allow pressurization of the compression chamber 68 when the actuator 20 is again depressed.

Figure 7:
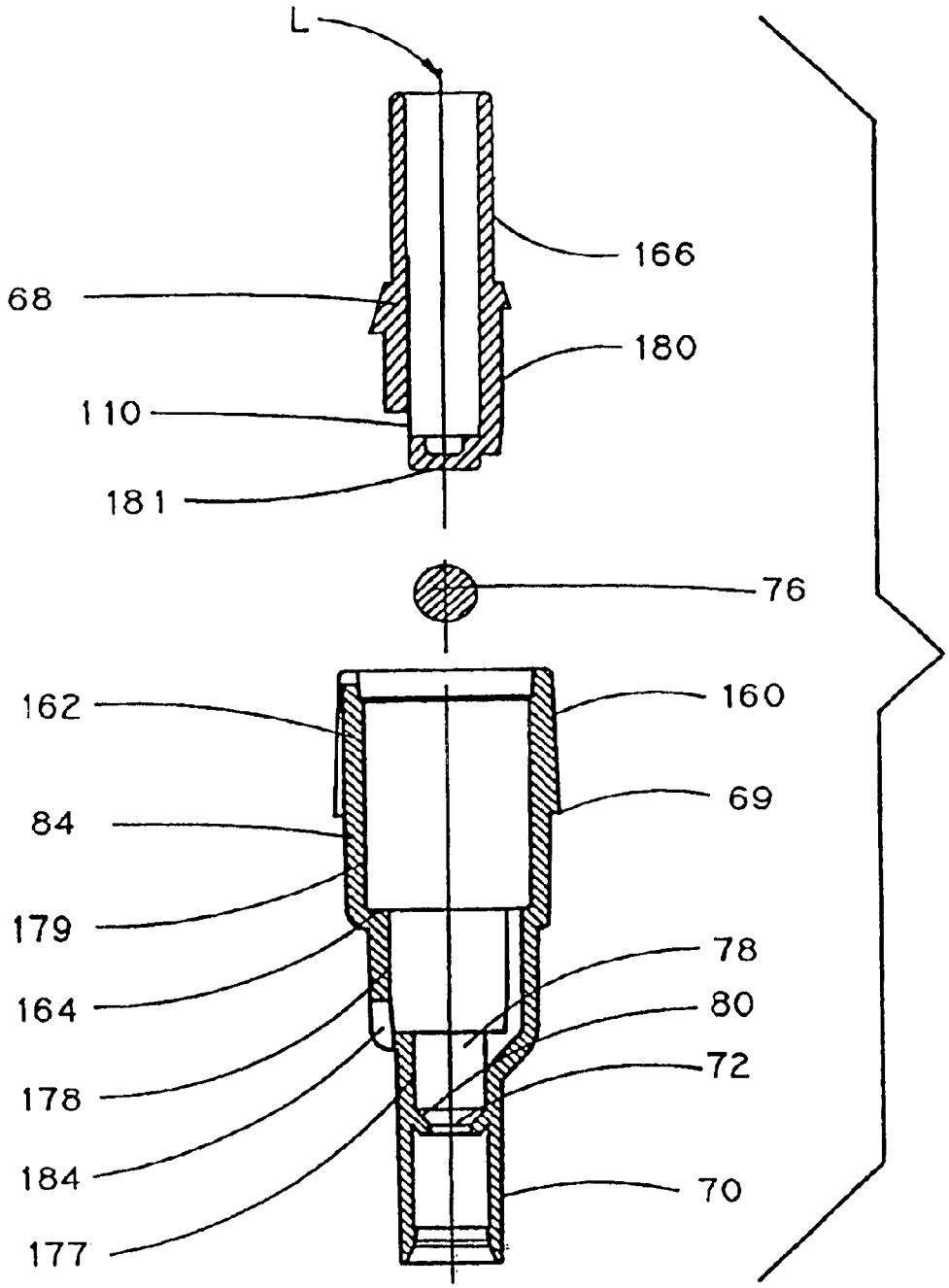
FIG. 7 is a diagrammatic cross-sectional exploded view of a second embodiment of the pump body for the improved pump assembly, according to the present invention.
Figure 8:
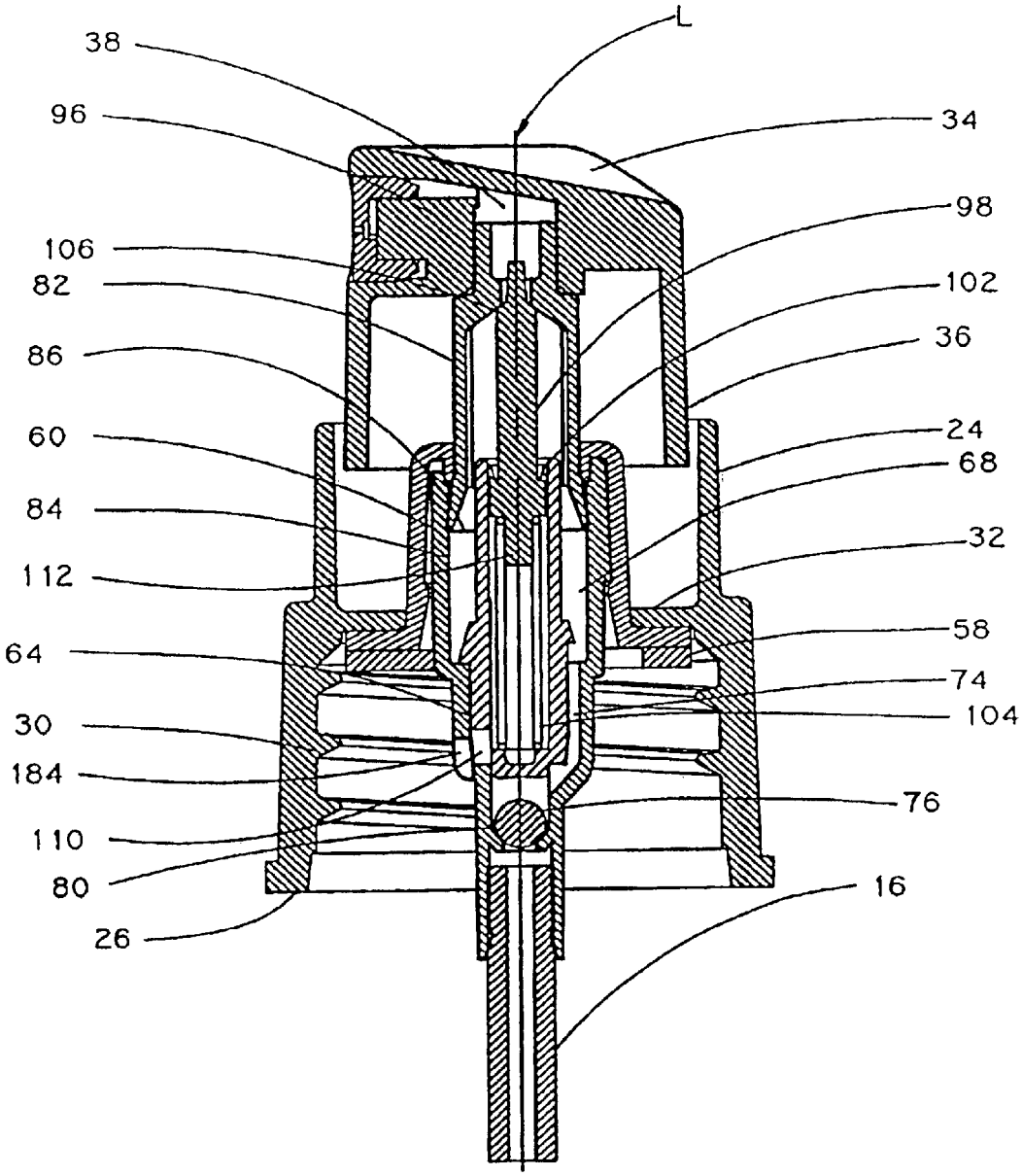
FIG. 8 is a diagrammatic cross-sectional view of the second embodiment of the improved pump assembly, according to the present invention, shown in the static position with an actuator, a closure, a liner and a dip tube attached thereto.

With reference to FIGS. 7 and 8, a second embodiment of the present invention will now be discussed. As this second embodiment is very similar to the first embodiment in many aspects, only the differences between the second and the first embodiments will be discussed in detail. In fact, the closure 18, the actuator 20, the ball 76, the piston 82, the poppet 98 and the spring 104 are identical in both embodiments and thus a further detail discussion concerning the same in not generally provided.

The major difference between the two embodiments can be readily seen in FIG. 7. A first difference is that the pump body 60 is formed as two separate components, i.e. the first component comprises the outer cylindrical housing 162 integral formed with the base 164 of the pump body 160 to form a unitary component or structure while the inner cylindrical housing 166 is a completely separate component. The interior of the pump body 160 has three distinct sections each having a different diameter, i.e. a first smaller diameter section 177 located adjacent a base of the pump body 160, a third larger diameter section 179 located adjacent an open end of the pump body 160, and a second intermediate diameter section 178 located between the smaller diameter section 177 and the larger diameter section 179. A lower cylindrical portion 180 of the inner cylindrical housing 166 is sized to have an interference fit, e.g. a few thousands of an inch or so, with the second intermediate section 178 of the pump body 160 so that the inner cylindrical housing 166 can be located concentric with respect to the outer cylindrical housing 162 and be captively retained thereby once engaged with the pump body 160.

A second difference is that a lower side wall section of the pump body 160 is provided with an aperture 184 and this aperture 184 is located to coincide with the ventilation port 110 formed in a side wall of the inner cylindrical housing 166, once the inner cylindrical housing 166 is received within the internal diameter of the base 164 of the pump body 160. As with the first embodiment, the ventilation port 110 provides communication between the centrally located interior cavity 100 and an interior space of the container 12 to ventilate the interior cavity so that the centrally located interior 100 is at ambient pressure and prevents the creation of either excess pressure or vacuum in the centrally located interior 100 during operation of the pump assembly 10.

A third difference relates to the retention of the metal ball 76. According to this embodiment, during assembly, the metal ball 76 is first placed within the pump body 160 and received by the first smaller diameter bore 177, prior to placing the inner cylindrical housing 166 within the internal diameter of the base 164 of the pump body 160. Thereafter, once the inner cylindrical housing 166 is received within the internal diameter of the base 164 of the pump body 160, a base 181 of inner cylindrical housing 166 functions as a stop to prevent the metal ball 76 from being dislodged from the first smaller diameter bore 177 thereby eliminating the need for the cage 78, as with the previous embodiment.

A fourth difference relates to the arrangement of the centrally located interior cavity 100 with respect to the inlet aperture 72 and the first smaller diameter bore 177. In the first embodiment, the centrally located interior cavity 100 has a longitudinal axis which coincides with the longitudinal axis L of the pump assembly while the inlet aperture 72 and the bore accommodating the metal ball 76 each have a longitudinal axis which extends parallel to by is offset with respect to the longitudinal axis L of the pump assembly. According to the second embodiment, the centrally located interior cavity 100 as well as both the inlet aperture 72 and the first smaller diameter bore 177 are all have longitudinal axes which coincide with the longitudinal axis L of the pump assembly.

An exterior surface of the pump body 160 supports an annular nub 69 which is located to engage with the annular lip 59 of the turret 52 and secure the pump body 160 to the turret 52. A lower portion of the pump body 160 is provided with a cylindrical extension 70 having an inlet aperture 72 formed in a base end surface thereof. A first end of the dip tube 16 is frictionally received and retained within the inlet aperture 72, as is conventionally done in this art.

The inlet aperture 72 communicates with a first portion of a compression chamber 68, formed between an exterior surface of the inner cylindrical housing 166 and an inwardly facing surface of the outer cylindrical housing 162, via a longitudinal passageway 74. The longitudinal passageway 74 extends parallel to but is spaced radially from the longitudinal axis L of the pump assembly. The metal ball 76 moves to and fro within the first smaller diameter section of the pump body 160 and forms a one way valve. This one-way valve allows the product to flow along the longitudinal passageway 74 when the ball 76 is spaced from an annular ball seat 80. As with the pervious embodiment, the ball 76 normally rests against the annular ball seat 80 to shut off product flow through the longitudinal passageway 74.

A piston 82 is at least partially accommodated within the pump body 160 and the piston 82 is slidably movable relative to the pump body 160. A first lower end 84 of the piston 82 is provided with an annular sealing lip 86, having an outer circumference slightly larger than the inner dimension of the outer housing 62 to provide a tight sealing engagement between the annular sealing lip 86 and the inner surface of the outer housing 162. During operation of the piston 82, the pressure generated within the compression chamber 86 assists with forcing the annular sealing lip 86 of the piston 82 into sealing engagement with the inwardly facing surface of the outer cylindrical housing 162. An exterior surface of the piston 82, adjacent the annular sealing lip 86, is provided with an annular shoulder 88 which abuts against the annular retaining edge 56 of the turret 52 to captively retain at least the first lower end 84 of the piston 82 within the pump body 160.

As with the first embodiment, a first portion of the compression chamber 68 is formed between the inner cylindrical housing 166 and the outer cylindrical housing 162. A remaining second portion of the compression chamber 68 is formed between an inwardly facing surface of the piston 82 and an exterior surface of the poppet 98. The hollow interior dimension of the piston 82 is slightly larger than the outer diameter of the inner cylindrical housing 166 and either the piston 82 and/or the inner cylindrical housing 166 may have a channel(s) formed thereon so that the first portion of the compression chamber 68 is in constant communication with the remainder of the compression chamber 68 regardless of the position of the piston 82 relative to the inner cylindrical housing 166.

The cylindrical poppet 98 is accommodated within a centrally located internal cavity 100 defined by the inner cylindrical housing 166. The poppet 98 is a solid elongate generally cylindrical member which supports an annular sealing and guide surface 102 adjacent a first lower end thereof. The annular sealing and guide surface 102 is sized to have an slight interference sliding fit with the inwardly facing surface of the inner cylindrical housing 166. The annular sealing and guide surface 102 slides along the inwardly facing surface of the inner cylindrical housing 166, in a sealed manner during operation of the pump assembly, and maintains the poppet 98 aligned with respect to the longitudinal axis L of the pump assembly 10. The poppet 98 is biased into a normally closed position, via a spring 104 accommodated within the centrally located interior cavity 100, so that the shoulder 106 of the poppet 98 abuts against the poppet valve seat 96, formed on the piston 82, to shut off flow through the piston outlet 92.

In a preferred form of the invention, a lower inwardly facing surface of the inner cylindrical housing 166 is provided with at least one nub or some other protrusion 114 so that when the annular sealing guiding surface 102 of the poppet 98 engages with the nub or some other protrusion, the remaining pressure in the compression chamber 68 is relieved and flows downward through the centrally located interior cavity 100 and out through the ventilation port 110 and aperture 184, provided in the base 164, into the interior space of the container 12.

According to a preferred form of the invention, the compression chamber which has a maximum transverse dimension or diameter of between 0.225 and 0.275 inches, and more preferably a diameter of about 0.250 inches and the piston has a stroke length of between 0.275 and about 0.325 inches, and more preferably a piston stroke length of about 0.300 inches. This results in a compression chamber diameter to piston stroke ratio of between about 4 to 5 and about 2 to 3 which facilitates achievement of an operating pressure of approximately 130 psi or so.

Figure 6:
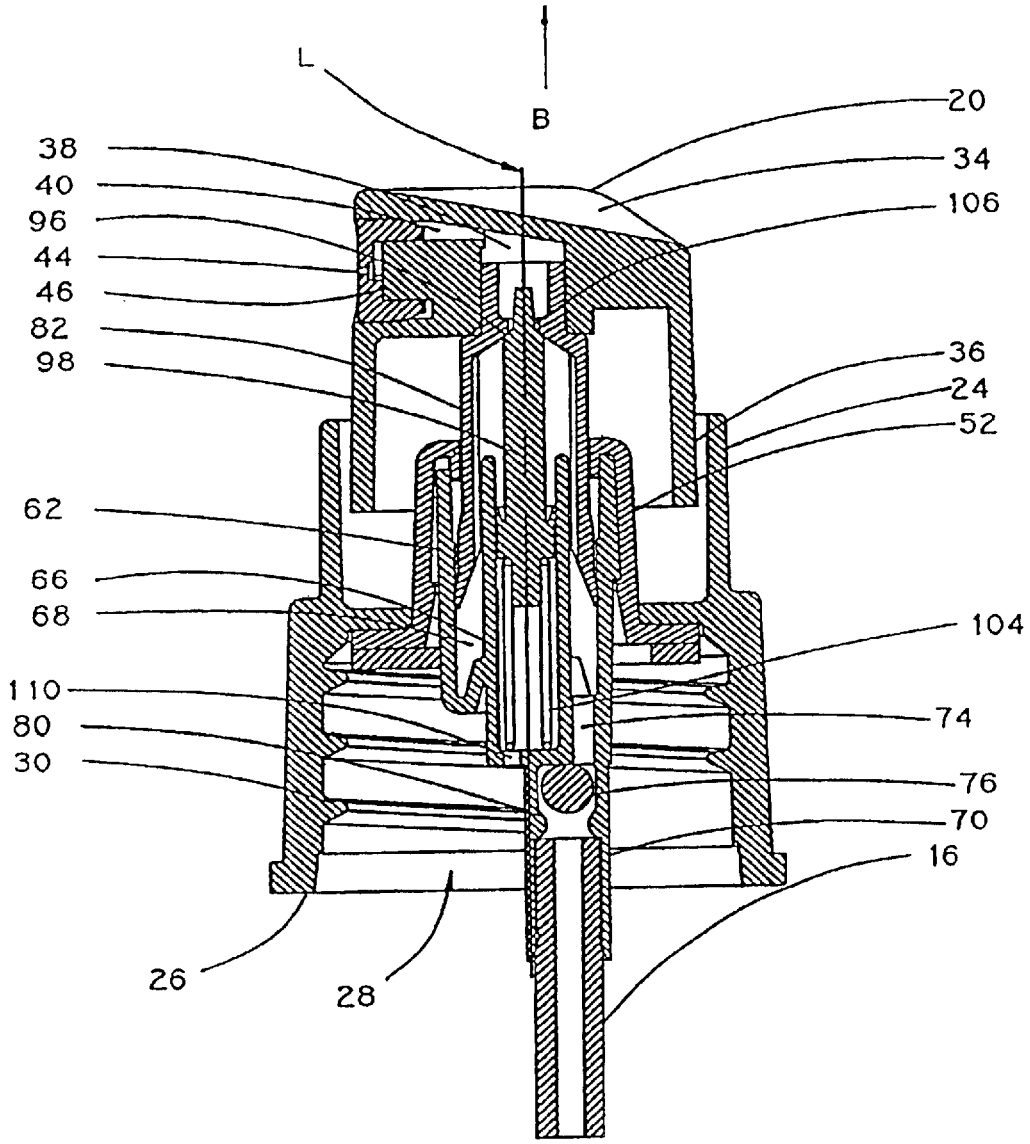
FIG. 6 is a diagrammatic cross-sectional view, of the first embodiment of the improved pump assembly of FIG. 3, shown in its partially returned position in which the poppet is biased against the poppet annular seat to facilitate suction of the product into the compression chamber during the return stroke of the improved pump assembly.

According to the design of the present invention, if, during depression of the actuator 20 toward the closure 18, the finger actuation pressure discontinues for any reason, once flow has been established through the piston outlet 92, the spring 104 will immediately bias the poppet 98 in the direction of arrow B of the FIG. 6, toward and against the poppet valve seat 96. This biasing action quickly closes the piston outlet 92 and thereby prevents the further flow of product to be dispensed 14 therethrough.

According to the present invention, passageway 74 leading to the compression chamber 68 extends along a second longitudinal axis LP which is off set with respect to the longitudinal axis L of the pump assembly but extends substantially parallel thereto. This arrangement facilitates venting of the base 64 of the central cavity 100 to the interior space of the container 12 so that the central cavity 100 operates at ambient pressure or to some other pressure other than the operating pressure of the compression chamber.

Since certain changes may be made in the above described finger operated pump assembly, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A finger pump assembly comprising:

a pump body having a base supporting an outer housing and an inner housing, said outer housing and said inner housing being coaxial with one another and said outer housing and said inner housing at least partially defining a compression chamber therebetween;

a closure supporting said pump body, and said closure having a mechanism for facilitating engagement with a spout of a container;

a piston being at least partially received within said pump body and being slidable relative to said pump body between the coaxial outer and inner housings and along said outer housing, said piston having an annular lip for providing a sealing engagement with the pump body, and said piston being provided with a poppet valve seat defining a piston outlet;

an actuator being coupled to said piston outlet, and said actuator having a discharge outlet communicating with said piston outlet for facilitating dispensing of a product;

a poppet being at least partially accommodated by the inner housing, said poppet being biased away from said base of said pump body by a spring into engagement with said poppet valve seat to normally close said piston outlet and prevent flow of product therethrough, and said poppet, said base and said inner housing defining an interior cavity, and said interior cavity being provided with a ventilation port which allows said interior cavity, during operation of said poppet, to operate at ambient pressure; and a passageway communicating directly with said compression chamber, said passageway having an inlet and a one-way valve which allows the product to flow along said passageway and directly into said compression chamber without passing through the interior cavity the passageway defines a longitudinal axis which is parallel to and coincident with a longitudinal axis of said finger pump assembly.

2. The finger pump assembly according to claim 1, wherein said poppet has an annular sealing and guide surface to facilitate sliding sealing engagement of the poppet along an inwardly facing surface of said inner housing.

3. The finger pump assembly according to claim 1, wherein said poppet is provided with a poppet shoulder for engaging with said poppet valve seat which defines the piston outlet, and said poppet has an appendage which extends through said piston outlet to facilitate alignment of said poppet with said piston outlet.

4. The finger pump assembly according to claim 1, wherein an end of said poppet, received within said inner housing, supports an extension which engages with a first end of said spring to facilitate orientation of said poppet along a longitudinal axis of said finger pump assembly.

5. The finger pump assembly according to claim 1, wherein said pump body is coupled to a turret and said turret is connected to said closure, and a remote free end of said closure supports an annular skirt which extends away from a base portion of said closure.

6. The finger pump assembly according to claim 5, wherein said turret has an annular sidewall and a free end portion of said annular sidewall is provided with an annular retaining edge for securely connecting said pump body to said turret.

7. The finger pump assembly according to claim 5, wherein said actuator is provided with an annular sidewall which engages with said annular skirt of said closure to facilitate actuation of said actuator along a longitudinal axis of said pump assembly.

8. The finger pump assembly according to claim 5, wherein said closure is provided with an annular flange, and said turret is provided with a mating annular flange, and said annular flange of said closure and a gasket sandwich said annular flange of said turret therebetween to facilitate a sealing engagement of said finger pump assembly with a desired container.

9. The finger pump assembly according to claim 1, wherein said actuator has a central bore which communicates with said discharge orifice, and said piston has an annular housing side wall which frictionally engages with said central bore of said actuator to couple said piston to said actuator and facilitate the supply of the product to be dispensed from said piston to said discharge orifice.

10. The finger pump assembly according to claim 1, wherein an inwardly facing surface of said inner housing is provided with at least one nub to facilitate relieving the pressure generated within the compression chamber once the popper has been substantially completely displaced along an inwardly facing surface of said inner housing, and the relieved pressure is vented through the interior cavity and out through the ventilation port provided in the base of the pump body.

11. The finger pump assembly according to claim 5, wherein at least one groove is provided between an exterior surface of said pump body an inwardly facing surface of said turret to allow an equalization in pressure, once the finger pump assembly is connected to a container and operated, to prevent the container attached to the finger pump assembly form becoming at least partially evacuated.

12. The finger pump assembly according to claim 1, wherein the passageway, communicating with said compression chamber, extends substantially parallel to a longitudinal axis of the pump assembly but is radially spaced from the longitudinal axis of the pump assembly.

13. The finger pump assembly according to claim 12, wherein the valve is located along said passageway communicating with said compression chamber, and said valve comprises a ball captively retained within a cage with said ball normally resting upon a ball valve seat to prevent flow of product along said passageway and, during a siphoning action of said pump assembly, said ball is displaced from said valve seat to allow the flow of the product therethrough.

14. The finger pump assembly according to claim 12, wherein a dip tube is coupled the inlet of the passageway to facilitate siphoning of the product to be dispensed form a base portion of a container.

15. A finger pump apparatus comprising:

a container for housing a desired product to be dispensed, said container being closed at one end and having a spout to facilitate dispensing of the product to be dispensed;

a pump body having a base supporting an outer housing and an inner housing, said outer housing and said inner housing being coaxial with one another and said outer housing and said inner housing at least partially defining a compression chamber therebetween;

a closure supporting said pump body, and said closure sealingly engaging with the spout of the container;

a piston being at least partially received within said pump body and being slidable relative to said pump body between the coaxial outer and inner housings and along said outer housing, said piston having an annular lip for providing a sealing engagement with the pump body, and said piston being provided with a poppet valve seat defining a piston outlet;

an actuator being coupled to said piston outlet, and said actuator having a discharge outlet communicating with said piston outlet for facilitating dispensing of a product;

a poppet being at least partially accommodated by said inner housing, said poppet being biased away from said base of said pump body by a spring into engagement with said poppet valve seat to normally close said piston outlet and prevent flow of product therethrough, and said poppet, said base and said inner housing defining an interior cavity, and said interior cavity being provided with a ventilation port which allows said interior cavity, during operation of said poppet, to communicate with an interior of the container so that the interior cavity operates at ambient pressure;

a passageway communicating directly with said compression chamber, said passageway having an inlet and a one-way valve which allows the product to flow along said passageway and directly into said compression chamber without passing through the interior cavity the passageway defines a longitudinal axis which is parallel to and coincident with a longitudinal axis of said finger pump assembly; and a dip tube coupling the inlet of the passageway to a base portion of said container to facilitate siphoning of the product to be dispensed by the pump assembly from an interior of the container.

16. The finger pump assembly according to claim 15, wherein said poppet has an annular sealing and guide surface to facilitate sliding sealing engagement of the poppet along an inwardly facing surface of said inner housing;

said poppet is provided with a poppet shoulder for engaging with said poppet valve seat which defines the piston outlet, and said poppet has an appendage which extends through said piston outlet to facilitate alignment of said poppet with said piston outlet;

an end of said poppet, received within said inner housing, supports an extension which engages with a first end of said spring to facilitate orientation of said poppet along the longitudinal axis of said finger pump assembly.

17. The finger pump assembly according to claim 15, wherein said pump body is coupled to a turret and said turret is connected to said closure, and a remote free end of said closure supports an annular skirt which extends away from a base portion of said closure;

said turret has an annular sidewall and a free end portion of said annular sidewall is provided with an annular retaining edge for securely connecting said pump body to said turret; and said actuator is provided with an annular sidewall which engages with said annular skirt of said closure to facilitate actuation of said actuator along the longitudinal axis of said pump assembly.

18. The finger pump assembly according to claim 17, wherein said closure is provided with an annular flange, and said turret is provided with a mating annular flange, and said annular flange of said closure and a gasket sandwich said annular flange of said turret therebetween to facilitate a sealing engagement of said finger pump assembly with a desired container.

19. The finger pump assembly according to claim 15, wherein said actuator has a central bore which communicates with said discharge orifice, and said piston has an annular housing side wall which frictionally engages with said central bore of said actuator to couple said piston to said actuator and facilitate the supply of the product to be dispensed from said piston to said discharge orifice.

20. The finger pump assembly according to claim 15, wherein an inwardly facing surface of said inner hosing is provided with at least one nub to facilitate relieving the pressure generated within the compression chamber once the poppet has been substantially completely displaced along an inwardly facing surface of said inner housing, and the relieved pressure is vented through the interior cavity and out through the ventilation port provided in the base of the pump body.

21. A single spring finger pump assembly comprising:

a pump body defining a longitudinal axis and having a base supporting an outer housing and an inner housing, said outer housing and said inner housing being coaxial with one another and with the longitudinal axis and said outer housing and said inner housing at least partially defining a compression chamber therebetween;

a closure supporting said pump body, and said closure having a mechanism for facilitating engagement with a spout of a container;

a piston being at least partially received within said pump body and being slidable relative to said pump body between the coaxial outer and inner housings and along said outer housing, said piston having an annular lip for providing a sealing engagement with the pump body, and said piston being provided with a poppet valve seat defining a piston outlet;

an actuator being coupled to said piston outlet, and said actuator having a discharge outlet communicating with said piston outlet for facilitating dispensing of a product;

a poppet being at least partially accommodated by the inner housing, said poppet being biased away from said base of said pump body by a spring into engagement with said poppet valve seat to normally close said piston outlet and prevent flow of product therethrough, and said poppet, said base and said inner housing defining an interior cavity, and said interior cavity being provided with a ventilation port which allows said interior cavity, during operation of said poppet, to operate constantly at ambient pressure; and a passageway communicating directly with said compression chamber, said passageway having an inlet and a one-way valve which allows the product to flow along said passageway and directly into said compression chamber without passing through the interior cavity, and the passageway extending parallel to the longitudinal and is coincident with the longitudinal axis.

22. The finger pump assembly according to claim 15, wherein the passageway, communicating with said compression chamber, extends substantially parallel to the longitudinal axis of the pump assembly but is radially spaced from the longitudinal axis of the pump assembly.

23. The finger pump assembly according to claim 22, wherein a valve is located along said passageway communicating with said compression chamber, and said valve comprises a ball captively retained within a cage with said ball normally resting upon a ball valve seat to prevent flow of product along said passageway and, during a siphoning action of said pump assembly, said ball is displaced from said valve seat to allow the flow of product therethrough.

24. The finger pump assembly according to claim 1, wherein a dip tube is coupled the inlet of the passageway to facilitate siphoning of the product to be dispensed from a base portion of a container.

25. A finger pump apparatus comprising:

a container for housing a desired product to be dispensed, said container being closed at one end and having a spout, at an opposite end to facilitate dispensing of the product to be dispensed;

a pump body comprising a base supporting an outer housing and an inner housing, said outer housing and said inner housing being coaxial with one another and said outer housing and said inner housing at least partially defining a compression chamber therebetween;

a closure supporting said pump body, and said closure having a mechanism for facilitating engagement with a spout of a container;

a piston being at least partially received within said pump body and being slidable relative to said pump body between the coaxial outer and inner housings and along said outer housing, said piston having an annular lip for providing a sealing engagement with the pump body, and said piston being provided with a poppet valve seat defining a piston outlet;

an actuator being coupled to said piston outlet, and said actuator having a discharge outlet communicating with said piston outlet for facilitating dispensing of a product;

a poppet being at least partially accommodated by the inner housing, said poppet being biased away from said base of said pump body by a spring into engagement with said poppet valve seat to normally close said piston outlet and prevent flow of product therethrough, and said poppet, said base and said inner housing defining an interior cavity, and said interior cavity being provided with a ventilation port which allows said interior cavity, during operation of said poppet, to operate at ambient pressure;

a passageway communicating directly with said compression chamber, said passageway having an inlet and a one-way valve which allows the product to flow along said passageway and directly into said compression chamber without passing through the interior cavity; and a dip tube coupling the inlet of the passageway to a base portion of said container to facilitate siphoning of the product to be dispensed by the pump assembly.

* * * * *